US005632550A

United States Patent [19]

Yeh

[11] Patent Number: 5,632,550

[45] Date of Patent: May 27, 1997

[54] DECORATIVE ARRAY LIGHTING SYSTEM

[76] Inventor: Ren S. Yeh, 521 South El Paso, El Paso, Tex. 79901

[21] Appl. No.: 538,247

[22] Filed: Oct. 3, 1995

[51] Int. Cl.[6] ..... F21P 1/02

[52] U.S. Cl. ..... 362/123; 362/251; 362/806

[58] Field of Search ..... 362/123, 249, 362/251, 252, 391, 806

[56] References Cited

U.S. PATENT DOCUMENTS

| | | | |
|---|---|---|---|
| 1,640,282 | 8/1927 | Migliaccio | 362/252 |
| 3,096,943 | 7/1963 | Forrer . | |
| 4,264,845 | 4/1981 | Bednarz | 315/323 |
| 4,720,773 | 1/1988 | Ahroni | 362/123 |
| 4,875,144 | 10/1989 | Wainright | 362/252 |
| 5,057,976 | 10/1991 | DuMong | 362/123 |
| 5,213,519 | 5/1993 | Dorfman | 439/505 |
| 5,379,202 | 1/1995 | Daun | 362/252 |
| 5,424,925 | 6/1995 | Jenke et al. | 362/123 |

*Primary Examiner*—Ira S. Lazarus
*Assistant Examiner*—Alfred Basichas
*Attorney, Agent, or Firm*—Charles C. H. Wu

[57] ABSTRACT

A decorative light array system includes a multiplicity of illuminators; a wire harness having a plurality of circuit paths for feeding the power to the illuminators and including a net portion supporting the illuminators, each of the circuit paths having a plurality of circuit branches extending across the net portion from spaced peripheral feeder locations thereof, a plurality of the illuminators being spaced apart and series-connected in each of the circuit branches, the circuit branches of each circuit path being parallel-connected, adjacent ones of the circuit branches being in different circuit paths; the net portion including net strands extending from proximate each of the illuminators to proximate at least one illuminator of an adjacent circuit branch for forming net intersections, and a multiplicity of translucent sleeve members, each sleeve member enclosing a corresponding illuminator and a portion of each net strand; and a control circuit connected to the wire harness, the control circuit having a connector for powering from an external source and being capable of separately and sequentially driving each of the circuit paths for activating corresponding subsets of the illuminators.

4 Claims, 4 Drawing Sheets

DECORATIVE ARRAY LIGHTING SYSTEM

BACKGROUND

The present invention relates to decorative lighting for displays such as Christmas trees and the like.

Array lighting systems are known in the prior art, being disclosed, for example in U.S. Pat. No. 2,096,943 to Forrer, U.S. Pat. No. 4,264,845 to Bednarz, U.S. Pat. No. 5,057,976 to DuMong, U.S. Pat. No. 5,213,519 to Dorfman, and U.S. Pat. No. 5,424,925 to Jenke et al. Specifically disclosed are a pliable conical frame having light sockets at frame intersections (Forrer), a array of LEDs at intersections of concentric and spiral conductors (Bednarz), a conical cloak-like assembly including strings of lights (DuMong), a net having lamp receptacles at intersections of a pair of conductors (Dorfman), and a combination of conductors and netting having low-profile illuminators through which pairs of the conductors extend (Jenke et al.). U.S. Pat. No. 4,264,845 to Bednarz and U.S. Pat. No. 4,259,709 to Eddings disclose flash circuits, sound and/or music elements to which illuminators can be responsive. The lights of the prior art have a number of disadvantages, including one or more of the following:

1. They are awkward to use in that they are restricted to relatively rigid patterns;

2. They are difficult to position on a Christmas tree in that projecting lamps get caught on foliage of the tree;

3. They are subject to damage when the lamps get caught in the foliage;

4. They are expensive to provide in that low profile lamps used therein are excessively complex;

5. They are expensive to provide in that they require elaborate computer drive circuitry; and 6. They are visually unattractive in that major portions of the array are bulky to view.

Thus there is a need for an array light system that avoids the disadvantages of the prior art.

SUMMARY

The present invention meets this need by providing an ornamental light array that has a plurality of illuminator strings in separately driven circuits and forming a net having illuminators at intersections thereof. In one aspect of the invention, a light array system includes a multiplicity of illuminators, a connection for receiving a source of electrical power, and a wire harness for powering the illuminators and having a net portion supporting the illuminators, a plurality of circuit branches of the harness extending across the net portion from spaced peripheral feeder locations thereof, a plurality of the illuminators being spaced apart and series-connected in each of the circuit branches, the net portion including net strands extending from proximate each of the illuminators to proximate at least one illuminator of an adjacent circuit branch for forming the net intersections.

Preferably the harness has a plurality of circuit paths, each of the circuit paths including at least one of the circuit branches, and the system includes a control circuit connected for separately driving each of the circuit paths for activating corresponding subsets of the illuminators. Each circuit path can include a plurality of parallel-connected circuit branches, the illuminators of each circuit branch being series-connected within the branch. Preferably adjacent ones of the circuit branches are in different circuit paths for creating an interlaced pattern of illuminators in the various circuit paths.

Preferably the control circuit is capable of sequentially driving the circuit paths for creating ornamental chase patterns. The control circuit can also be selectively operable in a steady state mode having each of the circuit paths continuously powered. The illuminators of each circuit path can be colored differently then the illuminators of the other circuit paths for permitting the system to generate changing color patterns. There can be four of the circuit paths, the illuminators being colored respectively red, green, yellow and blue in corresponding ones of the circuit paths, the illuminators in sequential ones of the circuit branches being in a repeating color sequence.

Preferably the wire harness further includes a multiplicity of translucent sleeve members, each sleeve member enclosing a corresponding illuminator and a portion of each net strand for effecting physical connections between the net strands and the circuit branches and insulating electrical connections to the illuminators. Preferably respective conductors of the corresponding circuit branch extend from opposite ends of each sleeve member for providing a low-profile illuminator configuration that is resistant to snagging on supporting structure such as tree foliage. The sleeve members can be outer sleeve members, the wire harness also having a multiplicity of translucent inner sleeve members that extend within corresponding ones of the outer sleeve members and enclosing the associated illuminator and circuit branch portions, the associated net strand extending between the inner and outer sleeve members. At least some of the illuminators can be incandescent bulbs. Similarly, at least some of the illuminators are light-emitting diodes (LEDs).

The net portion of the wire harness can be substantially rectangular, having a common connection to each of the circuit branches along one perimeter edge of the net portion, each circuit branch extending to an opposite perimeter edge of the net portion, an elongate member extending along respective side perimeter edges from the one perimeter edge and supporting alternate ones of the illuminators of associated circuit branches. A spaced plurality of hanger members can be connected along an upper perimeter edge of the net portion for suspending the wire harness from a curtain rod. The system can include a connectable plurality of wire harness segments, each segment having a rectangular net portion. Also the hanger members can be spaced along corresponding upper perimeter edges of the respective net portions. The segments can include at least one medial wire harness having connection branches extending from opposite side perimeter edges of the respective net portion, and a terminal wire harness having one connection branch extending from a side perimeter edge of the associated net portion.

Each net portion can have N of the circuit branches, N-1 of the net strands extending in zig-zag fashion between adjacent ones of the circuit branches and between opposite ends of associated circuit branches, the illuminators of each circuit branch extending in zig-zag fashion across the net portion. Further, there can be M of the illuminators in each of the circuit branches, M being approximately equal to N whereby the net portion is approximately square.

DRAWINGS

These and other features, aspects, and advantages of the present invention will become better understood with reference to the following description, appended claims, and accompanying drawings, where:

DESCRIPTION

Figure 1:
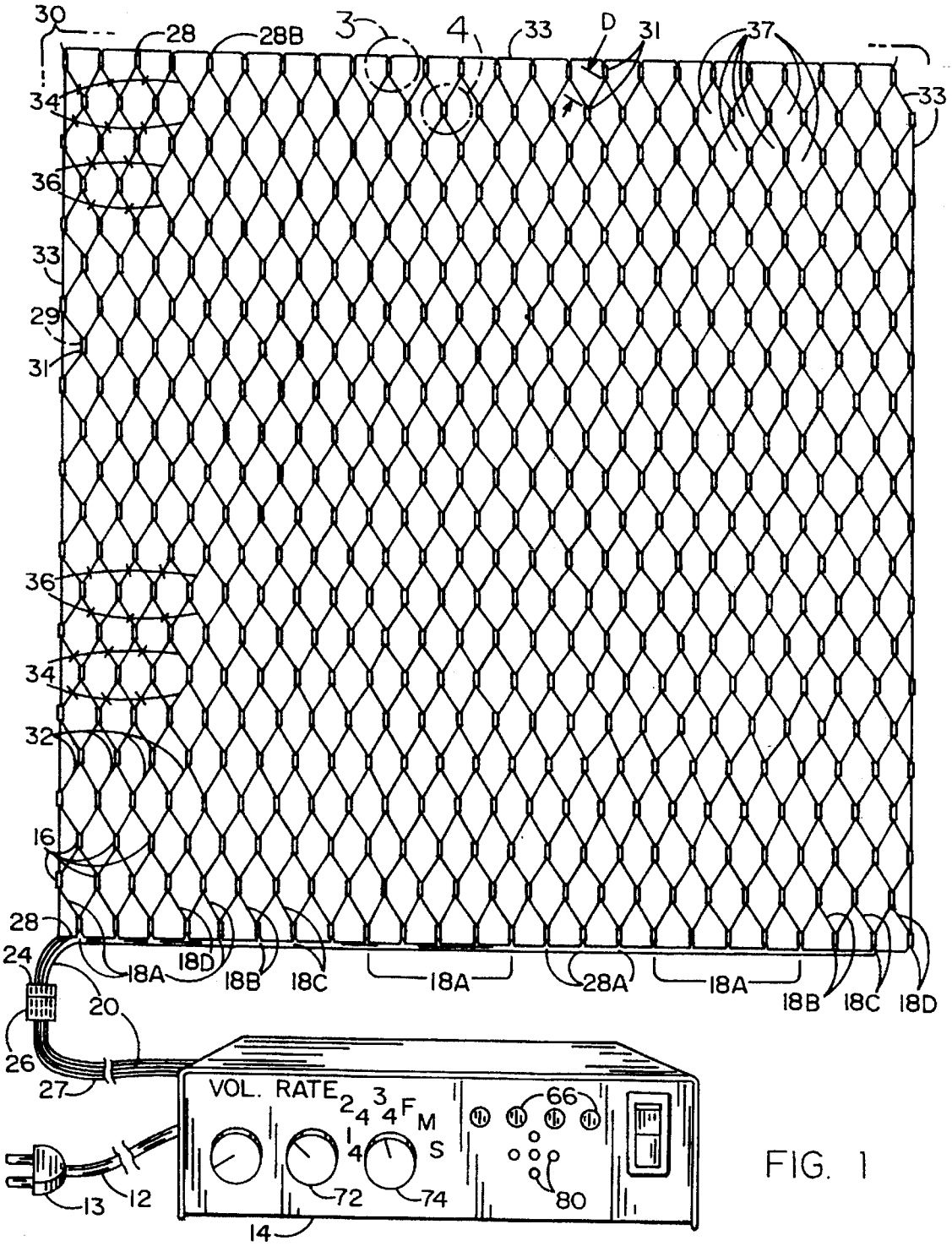
FIG. 1 is a front elevational perspective view of a light array system according to the present invention.

The present invention is directed to a light array system that is particularly suitable for decorating a wide variety of objects and structures, including Christmas trees and the like. With reference to FIGS. 1–4 of the drawings, an light array system 10 has a conventional power cord 12 having a plug connection 13 to a standard AC electrical power source (not shown), the power cord 12 being connected to a control unit 14 for activating a multiplicity of illuminators 16 of the system 10 by driving separate circuit paths 18 of a wiring harness 20, the circuit paths being individually designated 18A, 18B, 18C, and 18D. Optionally, the harness 20 includes a segment plug 24 and a segment socket 26, the socket 26 being spaced from the control unit 14, at the free end of an umbilical portion 27.

Figure 2:
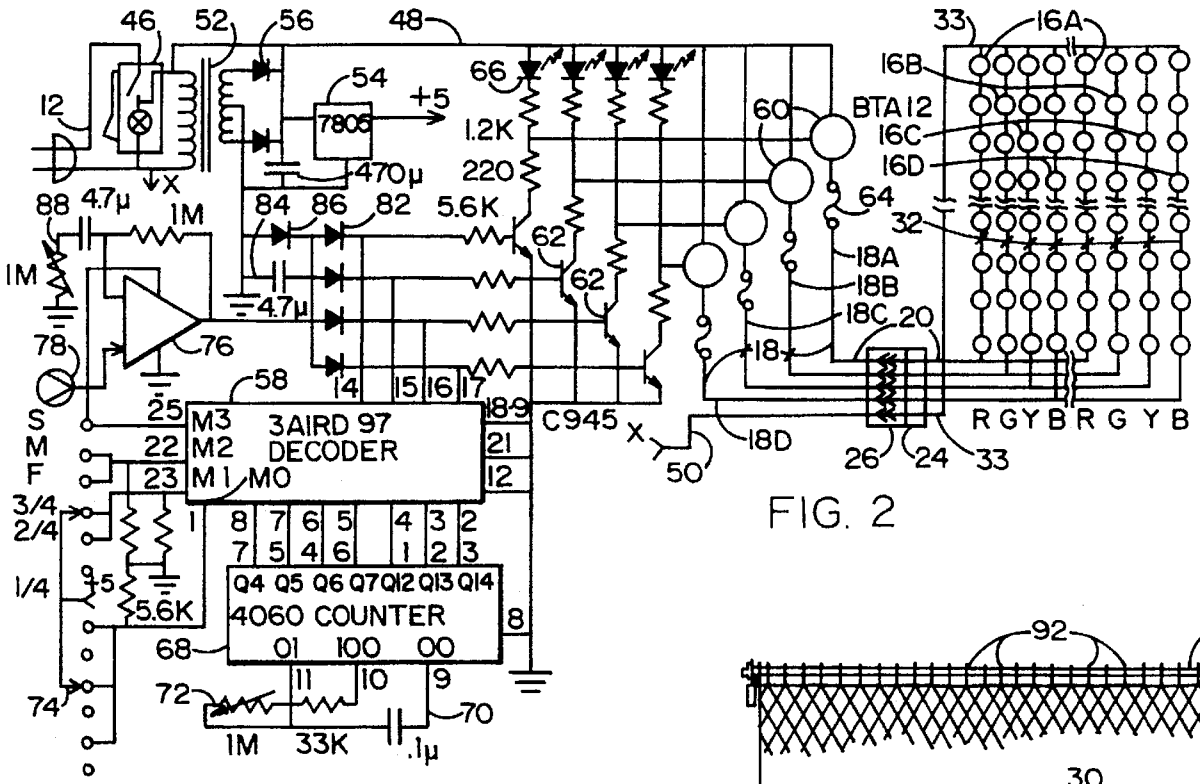
FIG. 2 is a schematic circuit diagram of the light array system of FIG. 1.
Figure 3:
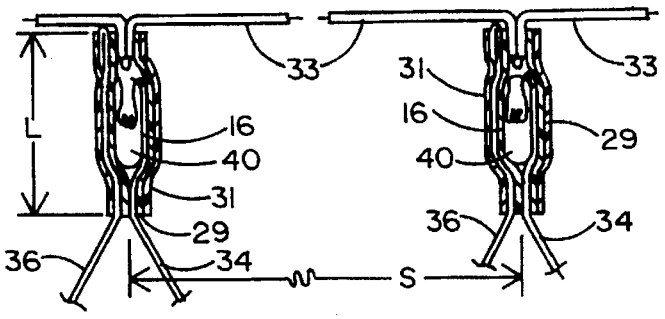
FIG. 3 is a fragmentary sectional detail view of the light array system of FIG. 1 within region 3 thereof.
Figure 4:
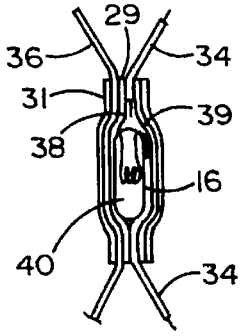
FIG. 4 is a fragmentary sectional detail view of the light array system of FIG. 1 within region 4 thereof.

According to the present invention, a plurality of feeder locations 28 are spaced along opposite marginal edges of a net region 30 of the harness 20, a plurality of light strings 32 being connected between corresponding pairs of the feeder locations 28 and having respective pluralities of the illuminators 16 therein, adjacent ones of the strings 32 being in different ones of the circuit paths 18, each of the light strings 32 forming a circuit branch of the harness 20. Further, a plurality of the light strings 32 are connected in each of the circuit paths 18, the exemplary configuration of FIG. 1 having six light strings 32 in each of the four circuit paths 18, a total of 24 light strings 32, there being twenty-two of the illuminators 16 in each string 32, a grand total of 528 illuminators 16. The connections to the respective circuit paths 18 are made at the feeder locations 28 that are located in FIG. 1 along one of the marginal edges of the net portion 30, designated 28A, with common connections to a single conductor 33 of the harness 20 being made at feeder locations 28 along the opposite marginal edge of the net portion 30, designated 28B, the connections to the common conductor 33 being shown most clearly in FIG. 3. In each of the light strings 32, the illuminators 16 are series-connected by a plurality of conductor segments 34. The connections of the conductor segments 34 to the illuminators 16 are reinforced and insulated by respective feeder sleeves 29, the sleeves 29 being formed from suitable lengths of translucent heat-shrink tubing enclosing corresponding ones of the illuminators 16. Also, a plurality of net strands 36 are connected between adjacent ones of the light strings 32 proximate alternate ones of the illuminators 16, the net strands 36 and the light strings 32 each extending in zig-zag fashion between the respective feeder locations 28, the strands 36 being clamped proximate the illuminators 16 by extending within respective lamp sleeves 31 together with the corresponding illuminator 16, the feeder sleeves 29, and portions of the conductor segments 34 as shown in FIGS. 3 and 4. The lamp sleeves 31 can also be formed from lengths of translucent heat-shrink tubing. In the configuration of FIGS. 1–4, the feeder locations are spaced at a spacing S, the sleeves 29 and 31 having a common length L as shown in FIG. 3, and being spaced apart at distances D along the respective light strings 32 and the net strands 36 as shown in FIG. 1, thereby forming an array of net cells 37 having four of the illuminators 16 at respective corners of a rhombus-like (rhomboid) structure.

As further shown in FIGS. 3 and 4, an exemplary form of each illuminator 16 is a miniature incandescent bulb having a pair of electrical leads 38 and 39 at one end of a capsule-shaped envelope 40. The lead 39 is folded back over the envelope 40, opposite ends of each conductor segment 34 being connected (by means such as soldering) between the lead 38 and the lead 39 of successive illuminators 16 of each light string 32. It will be understood, of course, that the leads 38 and 39 can alternatively extend axially from opposite ends of the envelope 40, in which case the lead 39 would not be folded back. Also, the illuminators 16 that are closest to the feeder locations 28 are preferably oriented with the leads 38 and 39 facing toward the respective locations 28 for facilitating common connections with respective conductors of the harness 20. Further, the common conductor 33 extends along side marginal edges of the net portion that are adjacent to that marginal edge having the feeder locations 28B, the conductor 33 being clamped by alternate ones of the lamp sleeves 31 of the light strings 32 that are located closest to the side marginal edges of the net portion 33 to function as counterparts of the net strands 36 for holding the zig-zag configuration of the light strings 32.

In a typical example of the system 10, the illuminators 16 that are associated with each of the circuit paths 18 are correspondingly colored so that activation of only one of the circuit paths 18 results in lighting from the system 10 being in the corresponding color only. As shown in FIG. 2, the illuminators 16, being colored red, green, yellow, and blue in the corresponding circuit paths 18A, 18B, 18C, and 18D, are respectively designated 16A, 16B, 16C, and 16D. Suitable devices for the illuminators 16 are low voltage incandescent lamps and light-emitting diodes (LEDs), series-connected in the respective light strings as shown in FIG. 2.

As shown in FIG. 2, the control unit 14 includes an illuminated power switch 46 for selectively powering each of the circuit paths 18 in the harness 20 between a power bus 48 and a common bus 50 (note connection x—x) with standard 117 volt AC power from the power cord 12, the common conductor 30 being connected to the common bus 50. A step-down transformer 52 having a center-tapped secondary is also connected to the power switch 46 for powering a conventional 5-volt DC regulator 54 through a pair of rectifier diodes 56, the input of the regulator 54 being referenced to the common bus 50. An integrated circuit decoder 58 activates each of the circuit paths 18 by driving corresponding semiconductor drivers 60 that are connected between the respective circuit paths 18 and the common bus 50 through respective switching transistors 62, the decoder 58 being powered by the regulator 54. As a precaution, a fuse 64 is connected in series with each of the semiconductor drivers 60. Suitable devices for the drivers 60 are available as type BTA 12 triacs, the transistors 62 being NPN type C945. Appropriate biasing and current limiting resistors are provided for the transistors 62 in a conventional manner, including respective light emitting diodes (LEDs) 66 for providing at the control unit 14 visual indications of activation of each of the circuit paths 18.

As further shown in FIG. 2, a multistage counter/oscillator 68 feeds the decoder 58 with a plurality of binary signals including a low-order group (Q4–Q7) and a high-order group (Q12–Q14), an R-C network 70 being connected to internal clock-buffer elements of the device and having a rate control 72 for providing an adjustable clock frequency. Also, a 2-pole, 6-position selector switch 74 having common connections to the 5-volt regulator 54 feeds the decoder 58 with a plurality of mode signals (M0–M3) to provide a variety of flashing modes of the light array system 10. In a first "¼" position of the switch 74, each of the mode signals M0–M3 are biased to logic ground, the decoder 58 being configured to sequentially and repetively activate the circuit paths 18, one at a time in a first chase cycle. In a second "¾" position of the switch 74, the mode signals M0 and M1 are connected to 5 volts, the decoder 58 being configured to similarly activate the circuit paths 18 two at a time in a second chase cycle. In a third "¾" position of the switch 74, the mode signal M1 only is connected to 5 volts, the decoder 58 being configured to likewise activate the circuit paths 18 three at a time in a third chase cycle. In a fourth "F" position of the switch 74, the mode signals M0 and M2 are connected to 5 volts, the decoder 58 being configured to repetively activate the circuit paths 18, progressing from one at a time to three at a time in a fourth chase cycle. In a fifth "M" position of the switch 74, the mode signal M2 only is connected to 5 volts, the decoder 58 being configured to sequentially and repetively activate the circuit paths 18 in a fifth chase cycle that periodically switches among the first, second, and third chase cycles. In a sixth "S" position of the switch 74, the mode signal M3 only is connected to 5 volts, the decoder 58 being disabled. However, the control unit 14 also includes a sound amplifier 76 for activating the circuit paths 18 (in unison) independently of the decoder 58 in response to a sound input, the amplifier 76 being powered only in the sixth position of the switch 74 by a common connection thereto with the mode signal M3. The decoder 58 can be implemented as an addressable four-bit by 1K memory device, the signals M0–M2 and the counter outputs Q4–Q7 and Q12–Q14 being address inputs, the signal M3 being a ground-true chip select. A suitable device is a conventional type "2732" read-only memory (ROM). The decoder 58 can also be implemented as a programmable logic array or "hard-wired" logic.

In an exemplary configuration as shown in FIG. 2, the sound input to the amplifier 76 is provided by a miniature microphone 78 that is located within the control unit 14 behind a plurality of housing openings 80 thereof, the openings 80 being shown in FIG. 1. The output of the sound amplifier 76 drives the switching transistors 62 through respective logic diodes 82, a filter capacitor 84 and clamping diode 86 also being connected between the output of the amplifier 76 and logic ground for preventing spurious activations of the circuit paths 18. The amplifier 76, shown in simplified form in FIG. 2, incorporates a conventional band-pass filter (not shown) and a gain control 88 for adjusting a threshold sound level to be received by the microphone 78 for activation of the circuit paths 18. Accordingly, the light array system 10 provides flashing of the illuminators 16 in synchronism with an external source of sound such as music in the sixth position of the selector switch 74. Preferably the gain control 88 is effective for selectively activating the circuit paths continuously even in the absence of sound input to the microphone 78, thereby providing an additional continuous mode of operation of the control unit 14 when the selector switch 74 is in the sixth position "S". The entire control unit 14 is also available as Model LC-403 "Do It Your Self" controller from Shenzhen Kinglanf Electronic Lighting Co. Ltd., Shenzhen, China.

Figure 5:
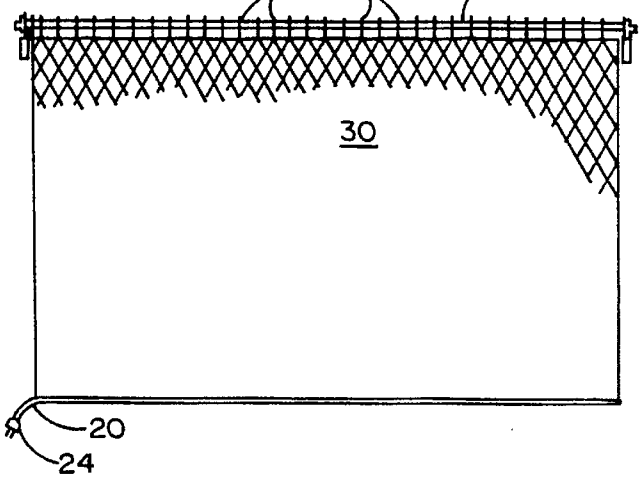
FIG. 5 is a front elevational view showing an alternative configuration of a portion of the system of FIG. 1.
Figure 6:
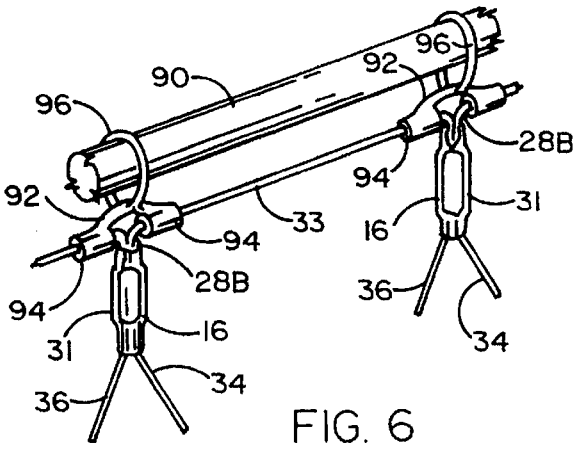
FIG. 6 is an oblique elevational detail perspective view of a portion of the system of FIG. 5 suspended from a curtain rod.

With further reference to FIGS. 5 and 6, the net portion 30 of the light array system 10 can be configured as a decorative curtain for suspension from a suitable horizontally disposed curtain rod 90, a plurality of hangar members 92 being connected to an upper edge margin the net portion 30 and slidably engaging the curtain rod 90. More particularly, each hangar member 92 in an exemplary configuration thereof is formed with a pair of sleeve portions 94 that are spaced on opposite sides below a loop portion 96. The hangar members 92 are located with the sleeve portions 94 straddling respective ones of the feeder locations 28B, the common conductor 33 extending through and being supported by the sleeve portions 94. The hangar members 92 can be formed of any suitable material, such as a molded engineering plastic. The hangar members 92 can be provided at some or all of the feeder locations 28B and if desired, the net portion 30 can be drawn aside on the curtain rod 90 in the manner of curtains generally.

Figure 7:
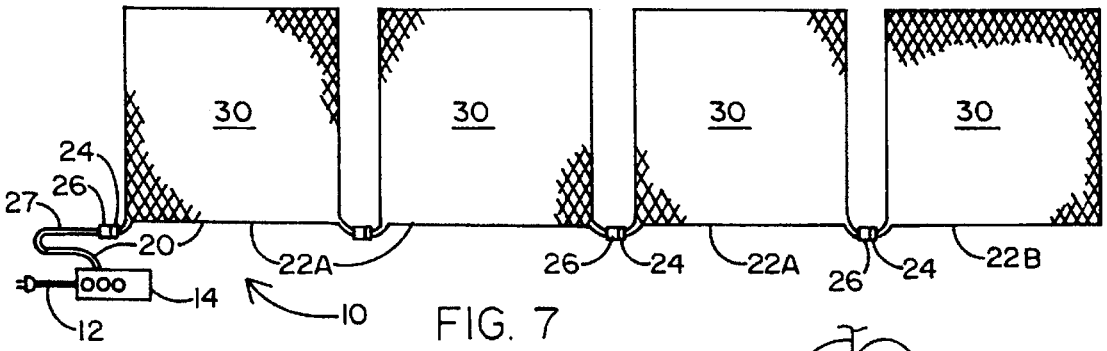
FIG. 7 is a front elevational view showing another alternative configuration of the light array system of FIG. 1.

With further reference to FIG. 7, an alternative configuration of the system 10 has the wiring harness 20 segmented, including at least one main segment 22A and an additional segment which can be an end segment 22B (being a counterpart of the net portion 30 in the configuration of FIGS. 1–4, the segments being collectively referred to as 22), and each main segment 22 having counterparts of the segment plug 24 and the segment socket 26 at opposite ends thereof whereby the main segments 22A can be connected in series. In each of the main segments 22A, the harness 20 has connections between corresponding elements of the segment plug 24 and the segment socket 26 so that corresponding ones of the light strings 32 of the various segments 22 are connected in parallel in each of the circuit paths 18. Thus the number of the segments 22 that can be operated at once is limited by the current capacity of the semiconductor drivers 60 and the fuses 64.

Figure 8:
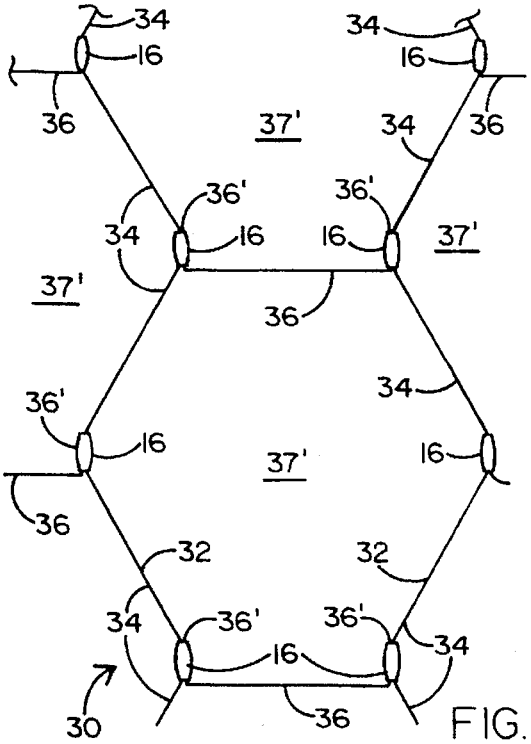
FIG. 8 is a detail view showing an alternative net cell configuration of the light array system of FIG. 1.

With further reference to FIG. 8, an alternative configuration of the harness 20 has counterparts of the cells, designated 37', in a quasi-hexagonal configuration. Particularly, each light string 32 extends generally vertically, the illuminators 16 of each light string 32 being offset laterally in zig-zag fashion as described above but with alternate ones of the light strings 32 being inverted laterally, segment counterparts of the string members 36 extending horizontally between facing illuminators of the respective light strings 32. The clamped connections between end extremities of the string members 36 are augmented by the string members 36 being looped back into the lamp sleeves 31 as indicated at 36'.

Figure 9:
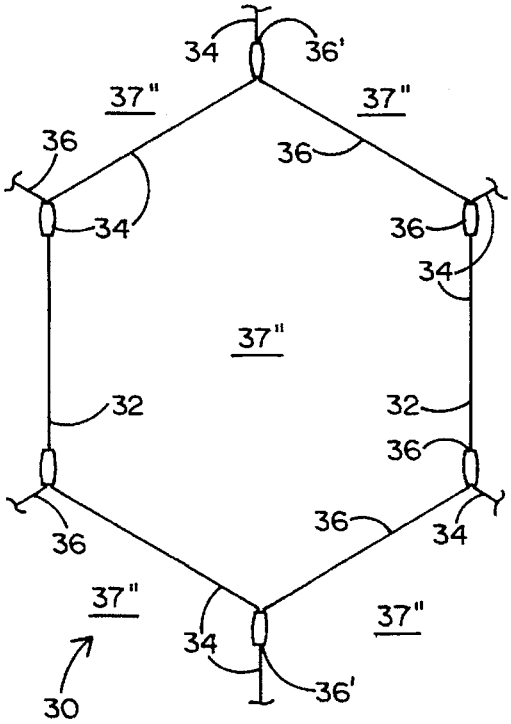
FIG. 9 is a detail view as in FIG. 8, showing another alternative net cell configuration.

With further reference to FIG. 9, another alternative configuration of the harness 20 has counterparts of the cells, designated 37", in a quasi-hexagonal configuration. Again, each light string 32 extends generally vertically, but with vertically spaced pairs of the illuminators 16 being offset laterally in zig-zag fashion, counterparts of the string members 36 extending diagonally between illuminators of the respective light strings 32.

Figure 10:
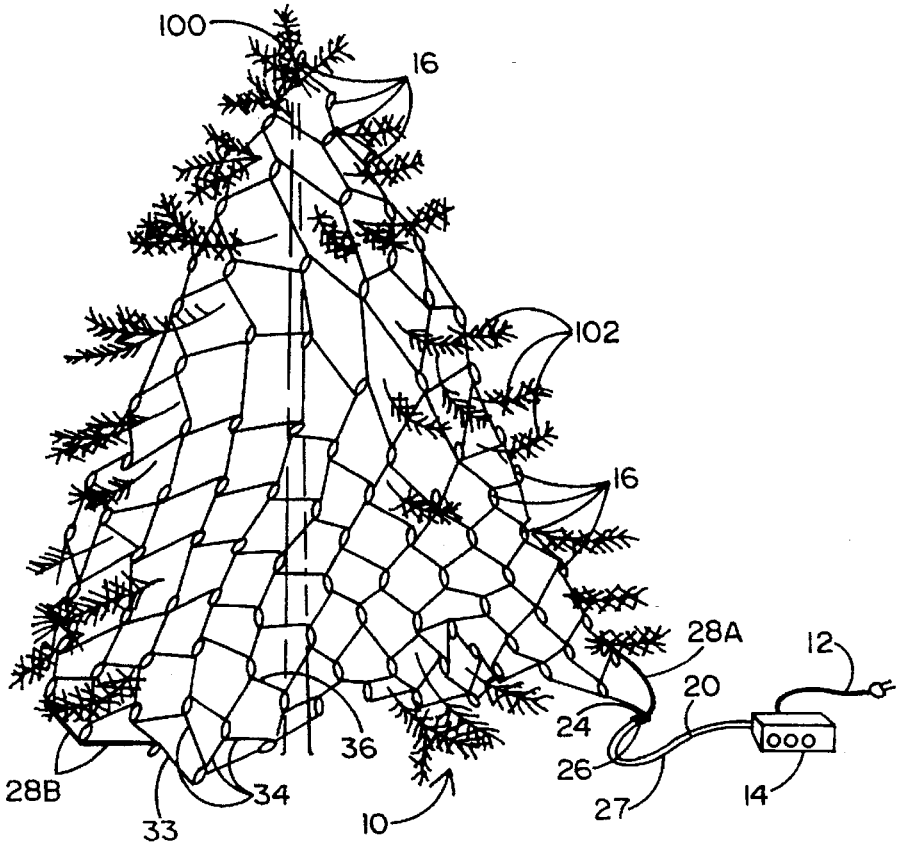
FIG. 10 is an elevational perspective view of the light array system of FIG. 1 deployed on a Christmas tree.

With further reference to FIG. 10, the light array system of FIGS. 1–4 is particularly suitable for use decorating a Christmas tree 100. In this application, the net portion 30, being generally rectangular, is preferably approximately square in outline. Thus the net portion 30 can be loosely placed on the tree 100 with the top of the tree 100 projecting upwardly approximately through a central region of the net portion 30, the perimeter of the net portion, including the common conductor 33, being draped outwardly and downwardly in full-skirt fashion about a lower portion of the tree 100, foliage 102 thereof projecting through at least some of the net cells 37. The illuminators 16, having low profile and being smoothly joined to the conductor segments 34 and the net strands 36 by the covering heat-shrink sleeves 29 and 31, are advantageously protected from damage that might otherwise be caused by normal handling and contact with the foliage 102 of the tree 100. Also, the net portion 30 provides a high degree of decorative illumination, the conductor segments 34 and the net strands 36 being of minimal visual distraction in that the illuminators 16 are located at every intersection of the net strands 36 with the conductor segments 34, and the conductor segments 34 are single conductors only.

Although the present invention has been described in considerable detail with reference to certain preferred versions thereof, other versions are possible. For example, the control unit 14 can be configured with an integrally mounted power plug. Also, the control unit 14 can be omitted when only a continuous mode of operation is desired. Therefore, the spirit and scope of the appended claims should not necessarily be limited to the description of the preferred versions contained herein.

What is claimed is:

1. A decorative light array system comprising a multiplicity of illuminators, means for connection to a source of electrical power, a wire harness having a plurality of circuit paths for feeding the source of electrical power to the illuminators, the wire harness further having a net portion supporting the illuminators, each of the circuit paths having a plurality of circuit branches extending across the net portion, the net portion having a plurality of net intersections, the net portion further includes net strands extending from each of the illuminators to at least one illuminator of an adjacent circuit branch for forming the net intersections, the wire harness further having a multiplicity of translucent sleeve member, each sleeve member enclosing a corresponding illuminator and a portion of each net strand, each of the circuit paths having a plurality of circuit branches extending across the net portion from spaced peripheral feeder locations thereof, a plurality of the illuminators being spaced apart and series-connected in each of the circuit branches the circuit branches of each circuit path being parallel-connected, adjacent ones of the circuit branches being in different circuit paths.

2. The light array system of claim 1, wherein respective conductors of the corresponding circuit branch extend from opposite ends of each sleeve member.

3. The light array system of claim 2, wherein the sleeve members are outer sleeve members, the wire harness further comprising a multiplicity of translucent inner sleeve members, each inner sleeve member extending within a corresponding one of the outer sleeve members and enclosing the corresponding illuminator and circuit branch portions, the portion of each net strand extending between the inner and outer sleeve members.

4. A decorative light array system comprising:

(a) a multiplicity of illuminators;

(b) means for connection to a source of electrical power;

(c) a wire harness having a plurality of circuit paths for feeding the source of electrical power to the illuminators and having a net portion supporting the illuminators, the net portion having a plurality of net intersections, each of the circuit paths having a plurality of circuit branches extending across the net portion from spaced peripheral feeder locations thereof, a plurality of the illuminators being spaced apart and series-connected in each of the circuit branches, the circuit branches of each circuit path being parallel-connected, adjacent ones of the circuit branches being in different circuit paths;

(d) the net portion including:

(i) net strands extending from each of the illuminators to at least one illuminator of an adjacent circuit branch for forming the net intersections; and (ii) a multiplicity of translucent sleeve members, each sleeve member enclosing a corresponding illuminator and a portion of each net strand; and (e) a control circuit connected between the power cord and the wire harness, the control circuit being capable of separately and sequentially driving each of the circuit paths for activating corresponding subsets of the illuminators.

* * * * *